US008590105B1

(12) United States Patent
Collins

(10) Patent No.: US 8,590,105 B1
(45) Date of Patent: Nov. 26, 2013

(54) WALL PROTECTION SYSTEM

(76) Inventor: Stephen P. Collins, Orrum, NC (US)

( * ) Notice: Subject to any disclaimer, the term of this patent is extended or adjusted under 35 U.S.C. 154(b) by 0 days.

(21) Appl. No.: 13/243,066

(22) Filed: Sep. 23, 2011

(51) Int. Cl.
*E05F 5/02* (2006.01)

(52) U.S. Cl.
USPC ..... 16/82; 16/86 A

(58) Field of Classification Search
USPC ..... 16/49, 82, 85, 86 R, 86 A; 292/DIG. 15, 292/DIG. 19; 220/9.1–9.4; 52/27, 173.1
See application file for complete search history.

(56) References Cited

U.S. PATENT DOCUMENTS

| | | | | |
|---|---|---|---|---|
| 1,663,966 | A * | 3/1928 | Ament et al. | 4/484 |
| 2,829,937 | A * | 4/1958 | Jones et al. | 248/188.8 |
| 3,133,758 | A * | 5/1964 | Wells | 292/251.5 |
| 3,864,785 | A * | 2/1975 | Hoppock | 16/86 A |
| 3,969,786 | A | 7/1976 | Peak | |
| 3,994,043 | A | 11/1976 | Gurzenda | |
| 4,294,364 | A * | 10/1981 | Bilbrey | 211/49.1 |
| 4,532,672 | A * | 8/1985 | Anderson | 16/86 A |
| D329,590 | S | 9/1992 | Chapman | |
| 5,188,243 | A * | 2/1993 | Ruiz | 211/70.2 |
| 5,390,878 | A * | 2/1995 | Padden | 244/53 R |
| 5,611,110 | A * | 3/1997 | Smith, Jr. | 16/2.1 |
| 5,722,115 | A * | 3/1998 | Arens | 16/85 |
| 6,321,412 | B1 * | 11/2001 | Duco | 16/85 |
| 6,430,775 | B1 | 8/2002 | Bushey | |
| 6,454,108 | B1 * | 9/2002 | Gerard | 211/74 |
| 6,698,596 | B1 * | 3/2004 | Dean | 211/13.1 |
| 6,763,956 | B2 * | 7/2004 | Woods | 211/74 |
| 8,251,209 | B2 * | 8/2012 | Shiao | 206/315.8 |
| 2010/0132161 | A1 | 6/2010 | Vu | |

* cited by examiner

*Primary Examiner* — William Miller

(57) ABSTRACT

A wall protection system having a first base with a rod surface and an outer surface, a plurality of rods extending outwardly from the rod surface of the first base, each rod has a first end attached to the rod surface of the first base and a second end, a second base having a rod surface and an outer surface, the rod surface of the second base is adapted to attach to the second ends of the rods.

6 Claims, 6 Drawing Sheets

WALL PROTECTION SYSTEM

FIELD OF THE INVENTION

The present invention is directed to a system for protecting sheetrock from damage due to contact with a doorknob.

BACKGROUND OF THE INVENTION

Doorknobs can cause damage to the wall (e.g., sheetrock) when the door is swung open. The present invention features a wall protection system for protecting walls (e.g., sheetrock) from such damage. The system of the present invention provides support for the area of the wall where the doorknob can contact. The system of the present invention can be used on various sized walls and on walls constructed from various materials.

SUMMARY

The present invention features a wall protection system. In some embodiments, the system comprises a wall protection system comprising a first base having a rod surface and an outer surface; a plurality of rods extending outwardly from the rod surface of the first base, each rod has a first end attached to the rod surface of the first base and a second end; a second base having a rod surface and an outer surface, the rod surface of the second base is adapted to attach to the second ends of the rods via a second attachment means.

In some embodiments, the first base is generally circular in shape. In some embodiments, the rods are arranged around a perimeter of the rod surface. In some embodiments, the rods are cylindrical in shape. In some embodiments, the second base is generally circular in shape.

In some embodiments, the system further comprises a first attachment means disposed on the outer surface of the first base.

In some embodiments, the first attachment means comprises an adhesive.

In some embodiments, a removable backing is removably attached to the adhesive on the outer surface of the first base. In some embodiments, the second attachment means comprises an adhesive. In some embodiments, a removable backing is removably attached to the adhesive on the rod surface of the second base.

In some embodiments, the system further comprises an expanding sealant foam positioned in between or around the rods.

In some embodiments, the system further comprises an inner drywall component and an outer drywall component, wherein a hole is disposed in the outer drywall component, the hole is adapted to allow passage of the first base and the rods, wherein the second base is either flush with the outer drywall component or protrudes form the hole.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
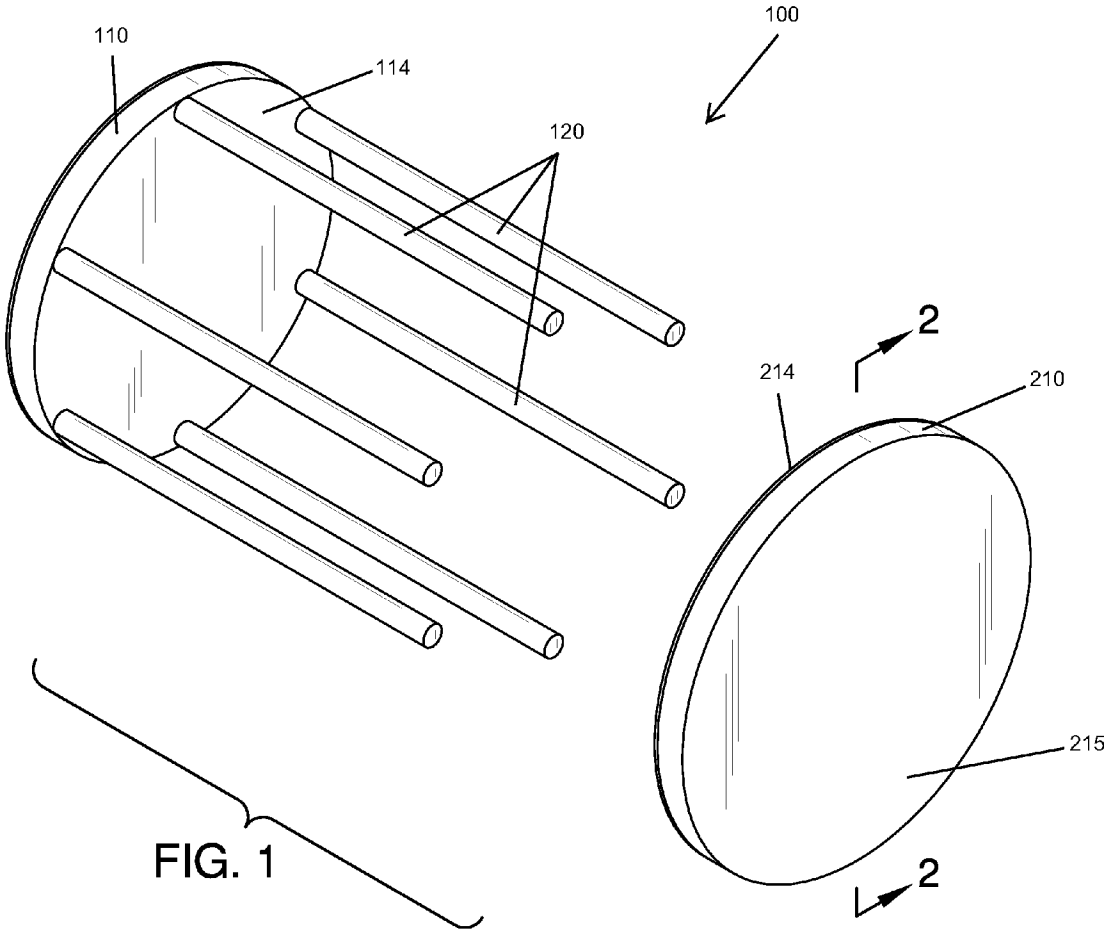
FIG. 1 is a perspective view of the system of the present invention.

Referring now to FIG. 1-4, the present invention features a wall protection system 100 for protecting walls (e.g., sheetrock) from damage by a doorknob 101. The system 100 comprises a first base 110 having a rod surface 114 and an outer surface 115 (the outer surface 115 being opposite the rod surface 114). In some embodiments, the first base 110 is generally circular in shape. In some embodiments, the first base 110 is generally flat. However, the first base 110 is not limited to this shape. For example, in some embodiments, the first base 110 is rectangular, oval, triangular, etc.

Extending outwardly from the rod surface 114 of the first base 110 is a plurality of rods 120. In some embodiments, the rods 120 are arranged symmetrically on the rod surface 114 of the first base 110. In some embodiments, the rods 120 are arranged asymmetrically on the rod surface 114. In some embodiments, the rods 120 are arranged around the perimeter of the rod surface 114 (e.g., see FIG. 1). Each rod 120 has a first end 121 (attached to the rod surface 114) and a second end 122. In some embodiments, the rods 12 are cylindrical in shape. However, the rods 120 are not limited to this shape. The rods 120 may be constructed from a variety of materials including but not limited to steel.

Figure 3A:
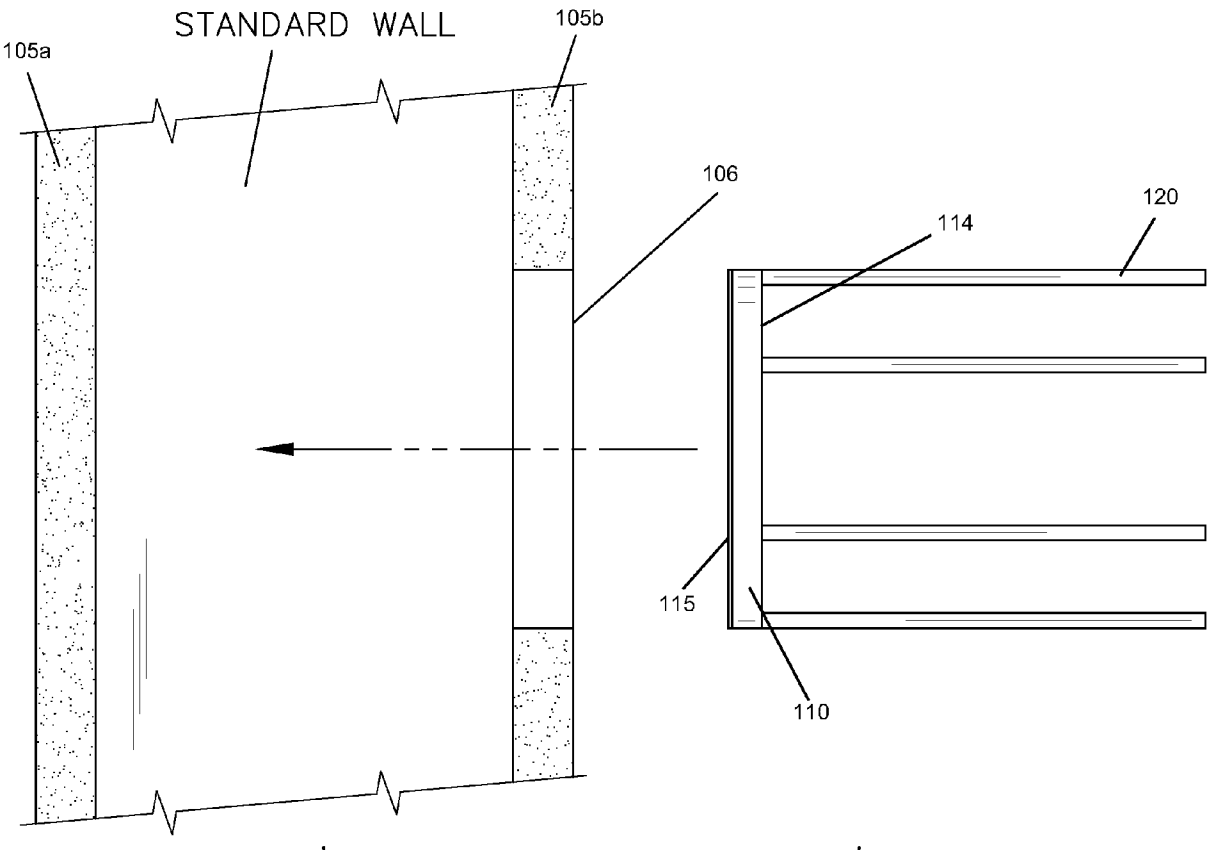
FIG. 3A is a first side view of the system of the present invention.

The first base 110 and the rods 120 are adapted to be inserted into drywall, for example in between an inner drywall component 105*a* and an outer drywall component 105*b* (e.g., see FIG. 3A).

The system 100 of the present invention further comprises a second base 210. The second base 210 is adapted to attach to the second ends 122 of the rods 120 via a second attachment means. The second base 210 has a rod surface 214 and an outer surface 215 (the outer surface 215 being opposite the rod surface 214). The second base 210 functions to provide protection from the doorknob 101. The second base 210 is positioned in the outer drywall component 105*b* (e.g., flush with the outer drywall component 105*b* or protruding from the outer drywall component 105*b*) as shown in FIG. 3C.

In some embodiments, the second base 210 is generally circular in shape. In some embodiments, the second base 210 is generally flat. However, the second base 210 is not limited to this shape. For example, in some embodiments, the second base 210 is rectangular, oval, triangular, etc.

Figure 2:
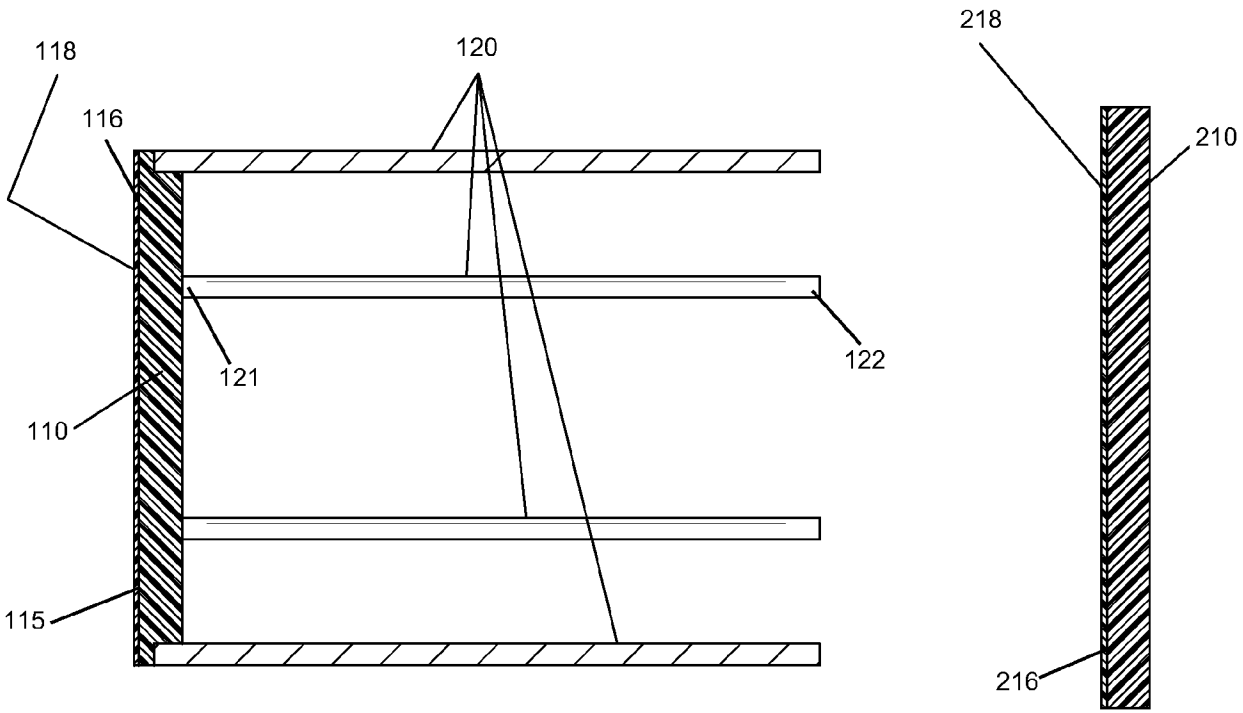
FIG. 2 is a side cross sectional view of the system of FIG. 1.

As shown in FIG. 3A, the first base 110 may attach to a piece of drywall (e.g., an inner drywall component 105*a*) via a first attachment means. As shown in FIG. 2, in some embodiments, the first attachment means comprises an adhesive 116. The adhesive 116 may be disposed on the outer surface 115 of the first base 110. In some embodiments, a removable backing 118 is removably attached to the adhesive 116 on the outer surface 115 of the first base 110. Adhesives and removable backings are well known to one of ordinary skill in the art.

As shown in FIG. 2, in some embodiments, the second attachment means comprises an adhesive 216. The adhesive

216 may be disposed on the rod surface 214 of the second base 210. In some embodiments, a removable backing 218 is removably attached to the adhesive 216 on the rod surface 214 of the second base 210. Adhesives and removable backings are well known to one of ordinary skill in the art.

Figure 3B:
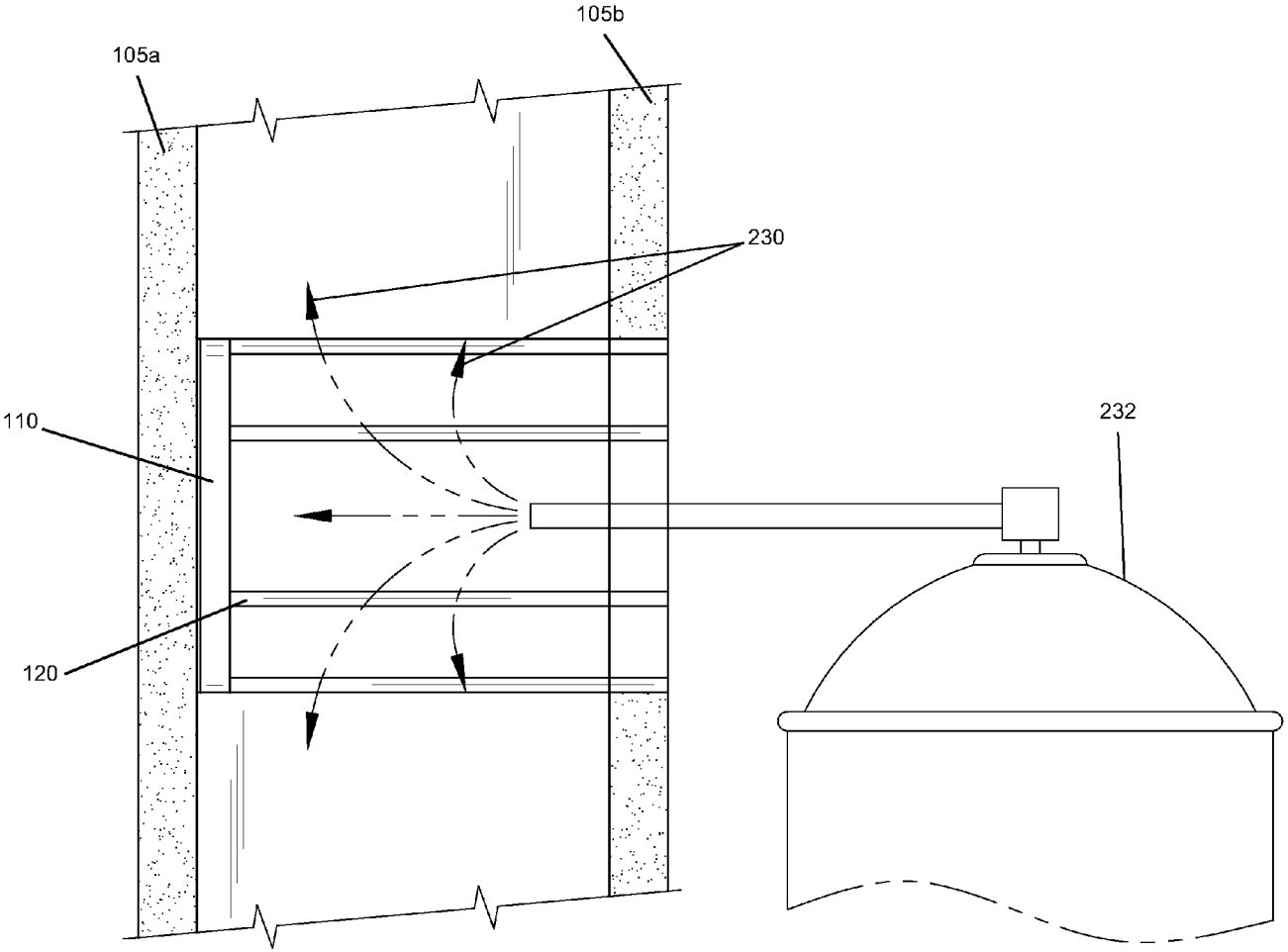
FIG. 3B is a second side view of the system of the present invention.
Figure 3C:
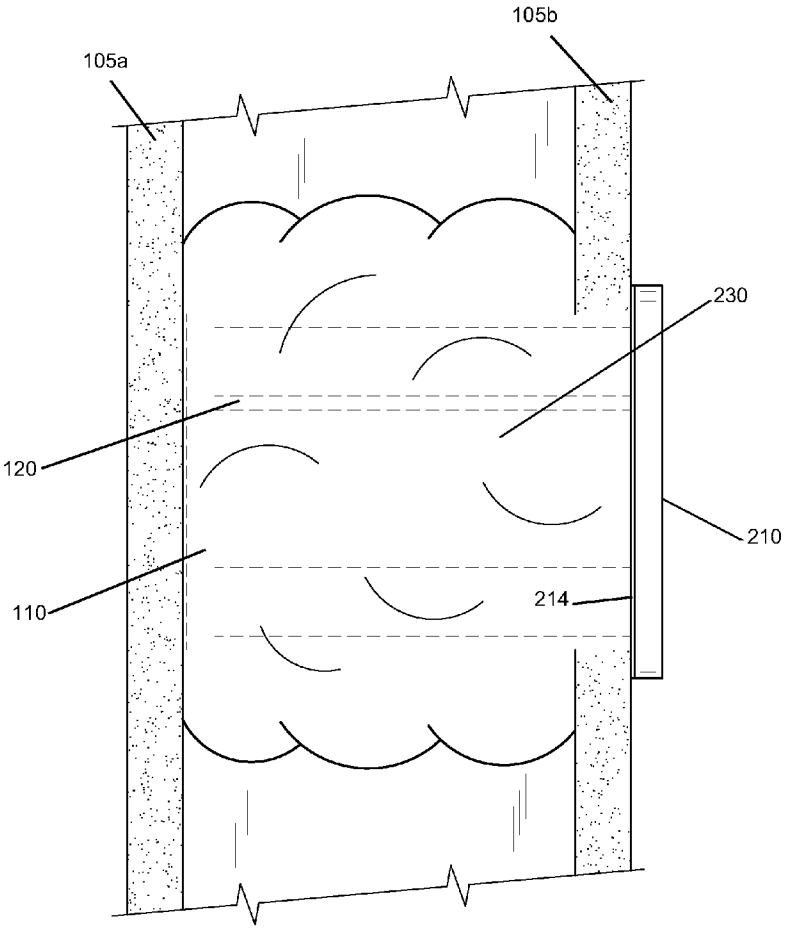
FIG. 3C is a third side view of the system of the present invention.
Figure 4:
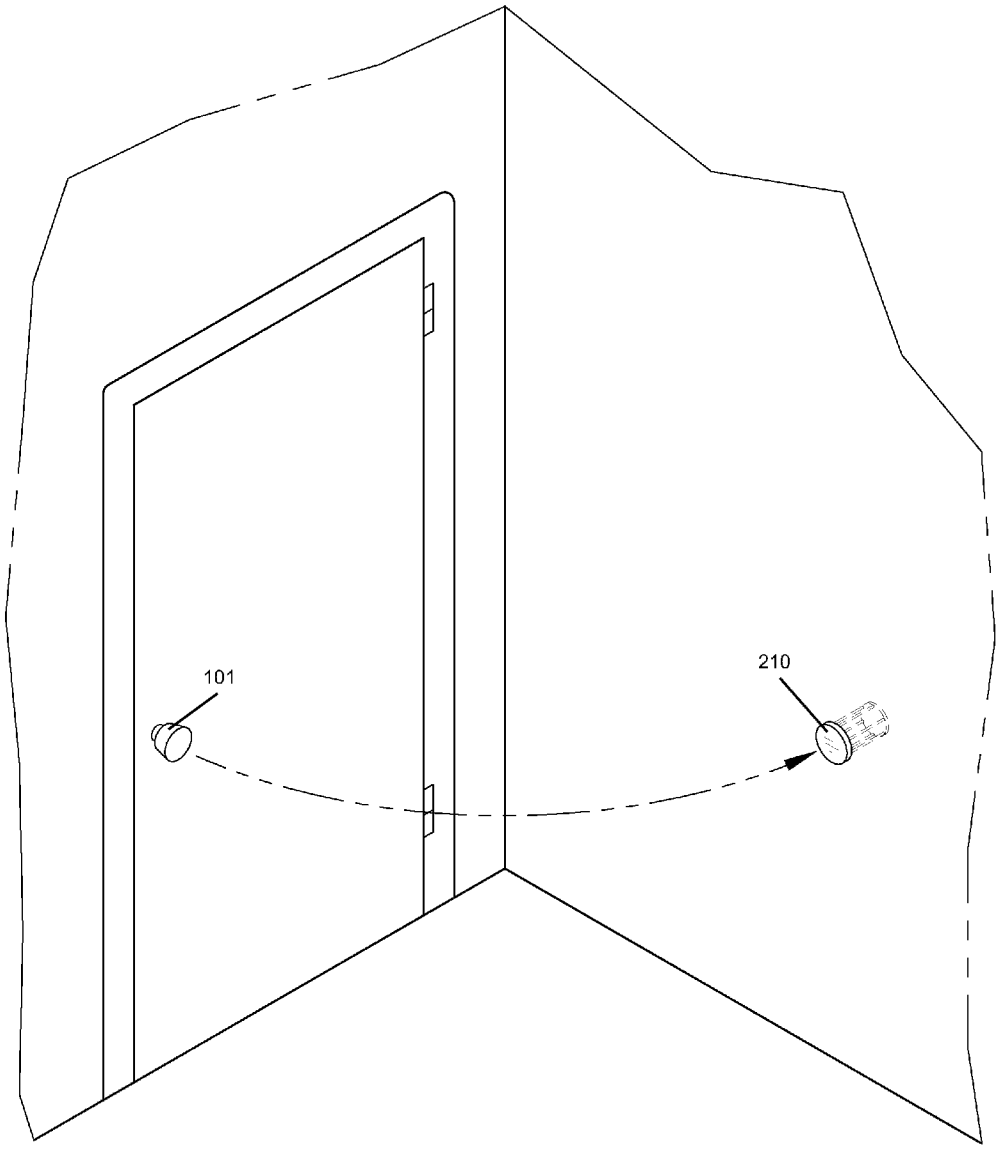
FIG. 4 is an in-use view of the system of the present invention.

As shown in FIG. 3A, FIG. 3B, and FIG. 30, a hole 106 is made in the drywall (e.g., in the outer drywall component 105*b*). The first base 110 and rods 120 are inserted through the hole 106. The outer surface 115 of the first base 110 is secured to the inner drywall component 105*a* (e.g., the removable backing 118 is removed prior to insertion). Expanding sealant foam 230 (e.g., from an expanding foam spray can 232) is inserted in between the rods 120 as shown in FIG. 3B. Expanding sealant foam 230 and expanding foam spray cans 232 are well known to one of ordinary skill in the art. The expanding foam sealant helps to secure the first base 110 and rods 120 in place. The second base 210 can be attached to the second ends 122 of the rods as shown in FIG. 3C (e.g., the removable backing 218 is removed). As shown in FIG. 4, the doorknob 101 contacts the second base 210 when the door is swung open.

The system 100 of the present invention may be constructed in a variety of sizes. For example, in some embodiments, the rods 120 are between about 2 to 4 inches in length as measured from the first end 121 to the second end 122. In some embodiments, the rods 120 are between about 4 to 6 inches in length as measured from the first end 121 to the second end 122. In some embodiments, the bases 110, 210 are between about 4 to 6 inches in diameter. In some embodiments, the bases 110, 210 are between about 6 to 8 inches in diameter. In some embodiments, the bases 110, 210 are different in size. In some embodiments, the bases 110, 210 are the same size. The present invention is in no way limited to the aforementioned dimensions.

In some embodiments, the system 100 further comprises the expanding sealant foam 230 (e.g., in between the rods 120). In some embodiments, the system 100 further comprises an expanding foam spray can 232. In some embodiments, the system 100 is a kit, wherein the kit comprises the first base 110, second base 210, rods 120, and an expanding foam spray can 232 for providing the expanding sealant foam 230.

As used herein, the term "about" refers to plus or minus 10% of the referenced number. For example, an embodiment wherein the first base 110 is about 5 inches in diameter includes a first base 110 that is between 4.5 and 5.5 inches in diameter.

The disclosures of the following U.S. Patents are incorporated in their entirety by reference herein: U.S. Pat. No. 3,969,786; U.S. Pat. No. 3,994,043; U.S. Design Pat. No. D329590; U.S. Pat. No. 6,321,412; U.S. Pat. No. 6,430,775; U.S. Patent Application No. 2010/0132161.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A wall protection system 100 comprising:

(a) a first base 110 having a rod surface 114 and an outer surface 115, a first attachment means disposed on the outer surface 115 of the first base 110, wherein the first attachment means comprises an adhesive 116;

(b) a plurality of rods 120 extending outwardly from the rod surface 114 of the first base 110, each rod 120 has a first end 121 attached to the rod surface 114 of the first base 110 and a second end 122;

(c) a second base 210 having a rod surface 214 and an outer surface 215, the rod surface 214 of the second base 210 is attached to the second ends 122 of the rods 120 via a second attachment means; and (d) a wall 105*a*, 105*b* wherein the first base 110 is positioned through a hole 106 in the wall and secured thereto via the adhesive 116.

2. The system 100 of claim 1, wherein a removable backing 118 is removably attached to the adhesive 116 on the outer surface 115 of the first base 110.

3. The system 100 of claim 1, wherein the second attachment means comprises an adhesive 216.

4. The system 100 of claim 3, wherein a removable backing 218 is removably attached to the adhesive 216 on the rod surface 214 of the second base 210.

5. The system 100 of claim 1 further comprising expanding sealant foam 230 positioned in between or around the rods 120.

6. The system 100 of claim 1, the wall comprising an inner drywall component 105*a* and an outer drywall component 105*b*, wherein the hole 106 is disposed in the outer drywall component 105*b*, the hole 106 is adapted to allow passage of the first base 110 and the rods 120, wherein the second base is either flush with the outer drywall component 105*b* or protrudes from the hole 106.

* * * * *